US006520101B2

(12) United States Patent
Sano et al.

(10) Patent No.: US 6,520,101 B2
(45) Date of Patent: Feb. 18, 2003

(54) SEWING MACHINE WITH A DEVICE FOR ADJUSTING A PRESSURE APPLIED TO A PRESSURE BAR AND A DEVICE FOR LIFTING THE PRESSER BAR

(75) Inventors: Yasuro Sano, Tokyo (JP); Masashi Ninomiya, Tokyo (JP); Eiji Murakami, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 10/010,302

(22) Filed: Nov. 13, 2001

(65) Prior Publication Data

US 2002/0062774 A1 May 30, 2002

(30) Foreign Application Priority Data

Nov. 24, 2000 (JP) ..... 2000-358559

(51) Int. Cl.[7] ..... D05B 29/02
(52) U.S. Cl. ..... 112/237
(58) Field of Search ..... 112/237, 235, 112/238, 239, 236

(56) References Cited

U.S. PATENT DOCUMENTS 1,440,343 A * 12/1922 DeVoe ..... 112/237
4,388,886 A * 6/1983 Adams ..... 112/237
4,495,876 A * 1/1985 Tajima ..... 112/102.5
5,960,730 A * 10/1999 Picker ..... 112/237

* cited by examiner

*Primary Examiner*—Ismael Izaguirre
(74) *Attorney, Agent, or Firm*—Nields & Lemack

(57) ABSTRACT

A sewing machine is disclosed, wherein a downward pressure normally applied to the presser bar may be optionally adjusted in response to a selected pattern of stitches, and further may be reduced when the presser bar is lifted from the lower operative position to the upper inoperative position, and the operation may be performed smoothly and efficiently. More precisely, the sewing machine substantially comprises a presser bar 1 having a presser foot 27 removably mounted to the lower end thereof and being vertically movable with respect to a needle plate by means of a presser bar holder 2 fixedly holding the presser bar 1, a spring 3 for normally giving a downward pressing force to the presser bar and a swingable member 20 which may be swingingly moved around a support pin 20*d* and has one end 20*e* operatively connected to the spring 3 and the opposite end 20*c* pressed against a positioning member 21 which is operated to swingingly move the swingable member 20 to displace the end 20*e* of thereof with respect to the spring 3 to adjust the pressing force of the spring 3.

13 Claims, 9 Drawing Sheets

SEWING MACHINE WITH A DEVICE FOR ADJUSTING A PRESSURE APPLIED TO A PRESSURE BAR AND A DEVICE FOR LIFTING THE PRESSER BAR

BACKGROUND OF THE INVENTION AND RELATED ART STATEMENT

1. Field of the invention

The present invention relates to a sewing machine and more particularly related to a sewing machine having a device for adjusting a pressure normally applied to a presser bar and a device for reducing the pressure when the presser bar is lifted, the devices being operated easily and smoothly.

2. Prior Art

Generally a sewing machine is provided with a presser bar having a presser foot removably mounted to the lower end thereof The presser bar is normally arranged under a downward pressure of a spring and may be vertically movable between an upper inoperative position where the presser foot is spaced from a cloth placed on a needle plate to be stitched and a lower operative position where the presser foot is pressed against the cloth so that stitches may be formed on the cloth. Generally the spring has a strong pressing force and the presser bar is normally lifted from the lower operative position to the upper inoperative position by operation of a lever against the strong pressing force of the spring. Further the pressing force is adjusted generally by loosening or fastening a screw which is in engagement with a top of the spring.

The cloth to be stitched may be different in type and thickness. Particular it is required to press a thick cloth or a leather against the needle plate with a comparatively strong pressure. It is, therefore, required to lift the presser bar against such strong pressure electrically or manually by operation of the presser bar lifting lever.

However, in case the presser bar lifting lever is operated to move up the presser bar, the strong pressure of the spring gives a heavy load to the members forming the transmission mechanism causing abrasion between the members of the transmission mechanism. This will detract a smooth operation for lifting the presser bar and shorten the working life of the mechanism.

OBJECTS OF THE INVENTION

The invention has been provided to eliminate the defects and disadvantages of the prior art. It is, therefore, a primary object of the invention to a sewing machine with a device for adjusting a pressure normally applied to a presser bar and a device for lifting the presser bar.

It is another object of the invention to operate devices which are compact in mechanism and smooth in operation.

It is another object of the invention to reduce the pressure normally applied to the presser bar when the presser bar is lifted.

The other objects and advantages of the invention will be apparent from the detailed description of the invention.

SUMMARY OF THE INVENTION

In order to attain the objects, the sewing machine of the invention comprises a presser bar supported on a machine frame and being vertically movable with a presser foot removably mounted to the lower end thereof, a spring normally giving a downward pressing force to the presser bar, a swingable member swingably supported on the machine frame and having one end engaging the spring and the opposite end engaging a positioning member which is operated to swing the swingable member to displace the one end thereof with respect to the spring to adjust the pressing force of the spring to the presser bar, thereby to adjust the pressing force of the spring applied to the presser foot which is pressed against a work placed on a needle plate to be stitched.

In a preferred embodiment, the swingable member is operated by a drive device including a pulse motor. Means for selecting a pressure applied to the presser bar may be provided to operate the swingable member. In case an embroidery pattern is stitched, an embroidery pattern may be optionally selected with simultaneous selection of a pressure to be applied to the presser bar which is most suitable to the selected pattern.

Further the sewing machine of the invention comprises a presser bar supported on a machine frame and being vertically movable with a presser foot removably mounted to the lower end thereof, a spring normally giving a downward pressing force to the presser bar, a swingable member swingably supported on the machine frame and having one end engaging the spring and the opposite end engaging a positioning member which is operated to swing the swingable member to displace the one end thereof with respect to the spring to adjust the pressing force of the spring to the presser bar, presser bar lifting means for moving up the presser bar, wherein the positioning member being operated in association with operation of the presser bar lifting means to swing the swingable member to displace the one end thereof with respect to the spring to nullify the pressing force of the spring to the presser bar, thereby to reduce the pressing force of the spring applied to the presser bar when the presser bar is lifted.

The presser bar lifting operation and nullification of the spring action may be made by a mechanism which is operated by a pulse motor. Further, the presser bar may be lifted by manual operation and the spring action may be nullified by the mechanism which is operated by a pulse motor. The manual operation may include the operation by hand or by knee.

(a) is a front elevational view of an entire structure of the invention partly shown in vertical section.

(b) is a side elevational view of (a) partly shown in vertical section.

FIG. 2:

(a) is a front elevational view of a structure of the invention partly shown in vertical section, wherein a presser bar is moved down.

(b) is a front elevational view of a structure of the invention partly shown in vertical section, wherein the presser bar is moved up.

Figure 2:
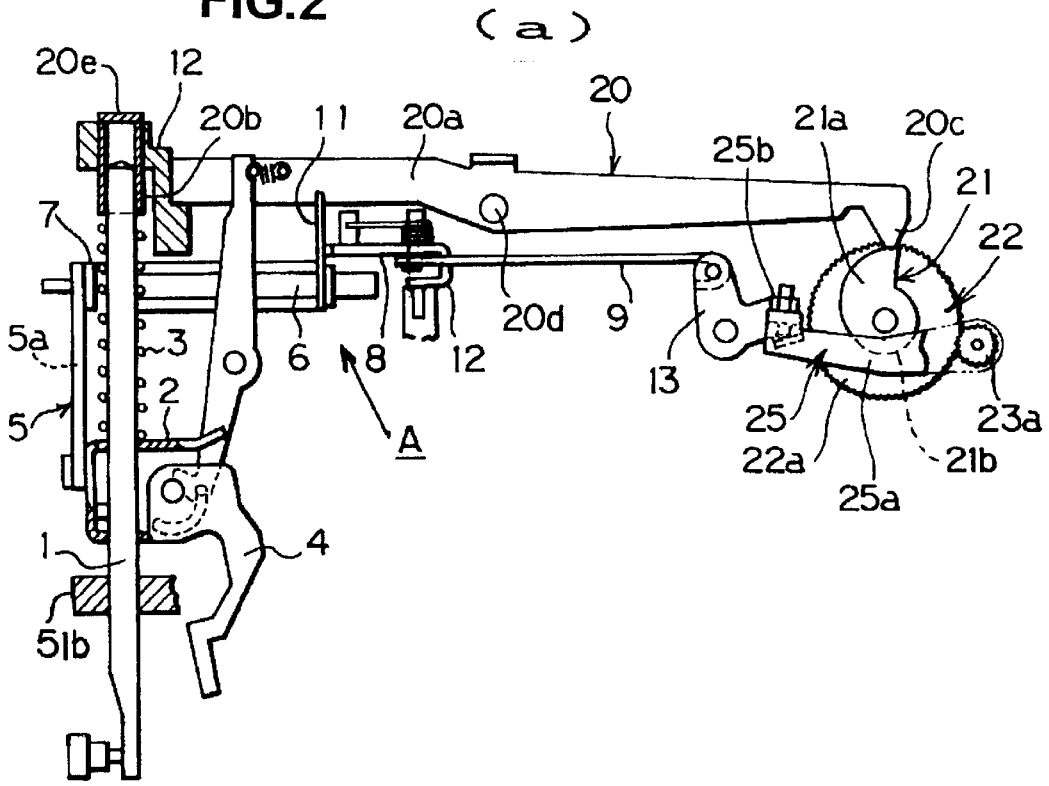
Figure 2:
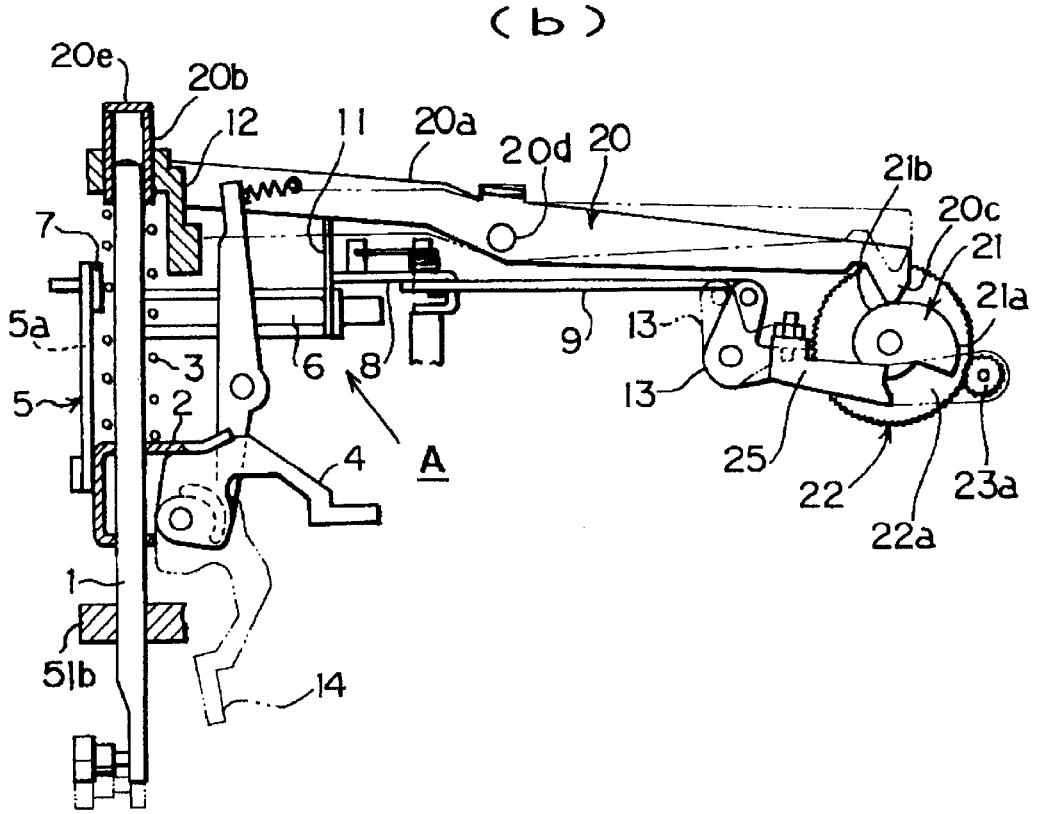

FIG. 3:

(a) is a front elevational view of a part of FIG. 2(*a*).

Figure 1:
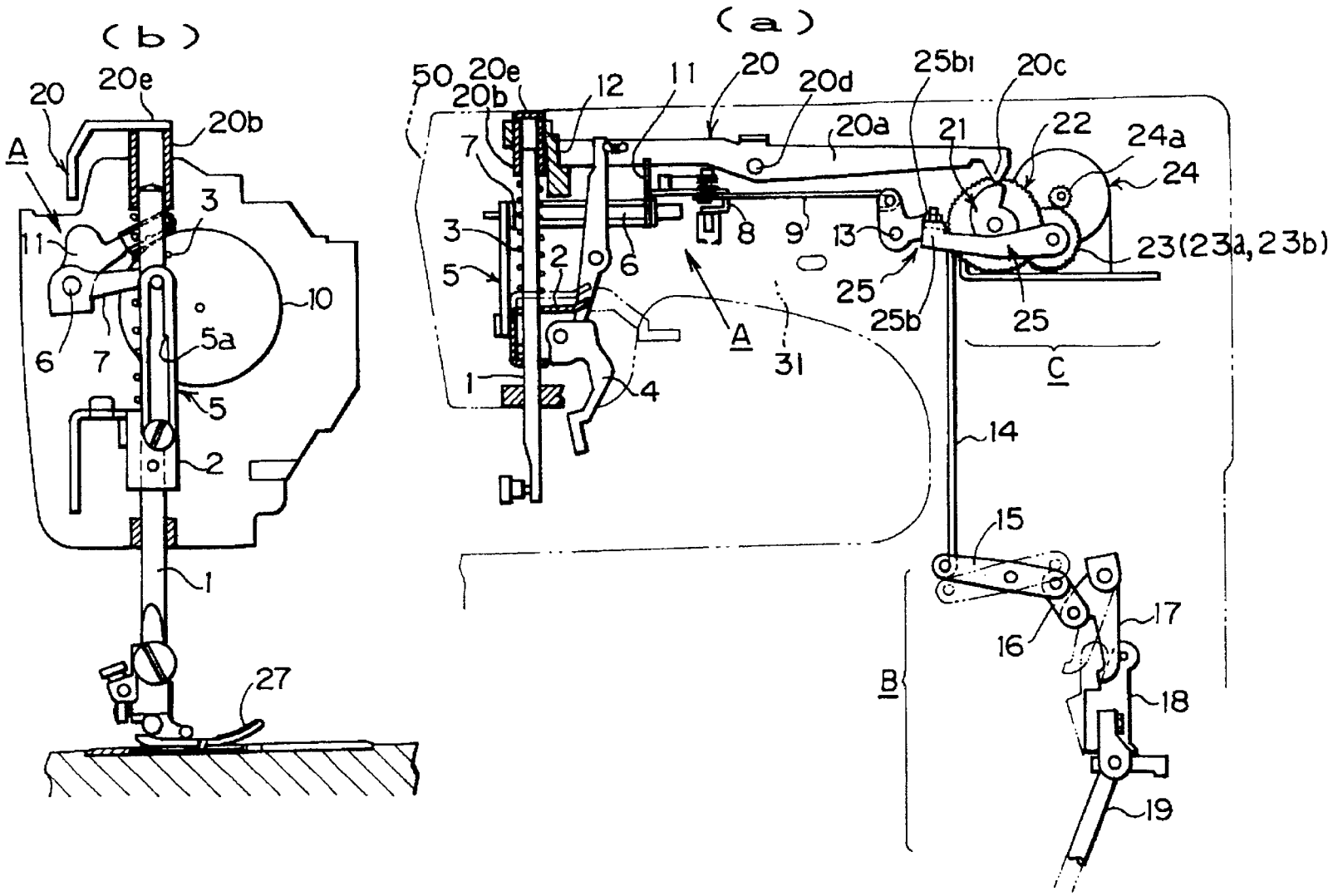
FIG. 1.

(b) is a front elevational view of a part of FIG. 1(*a*) showing a knee lever mechanism.

Figure 3:
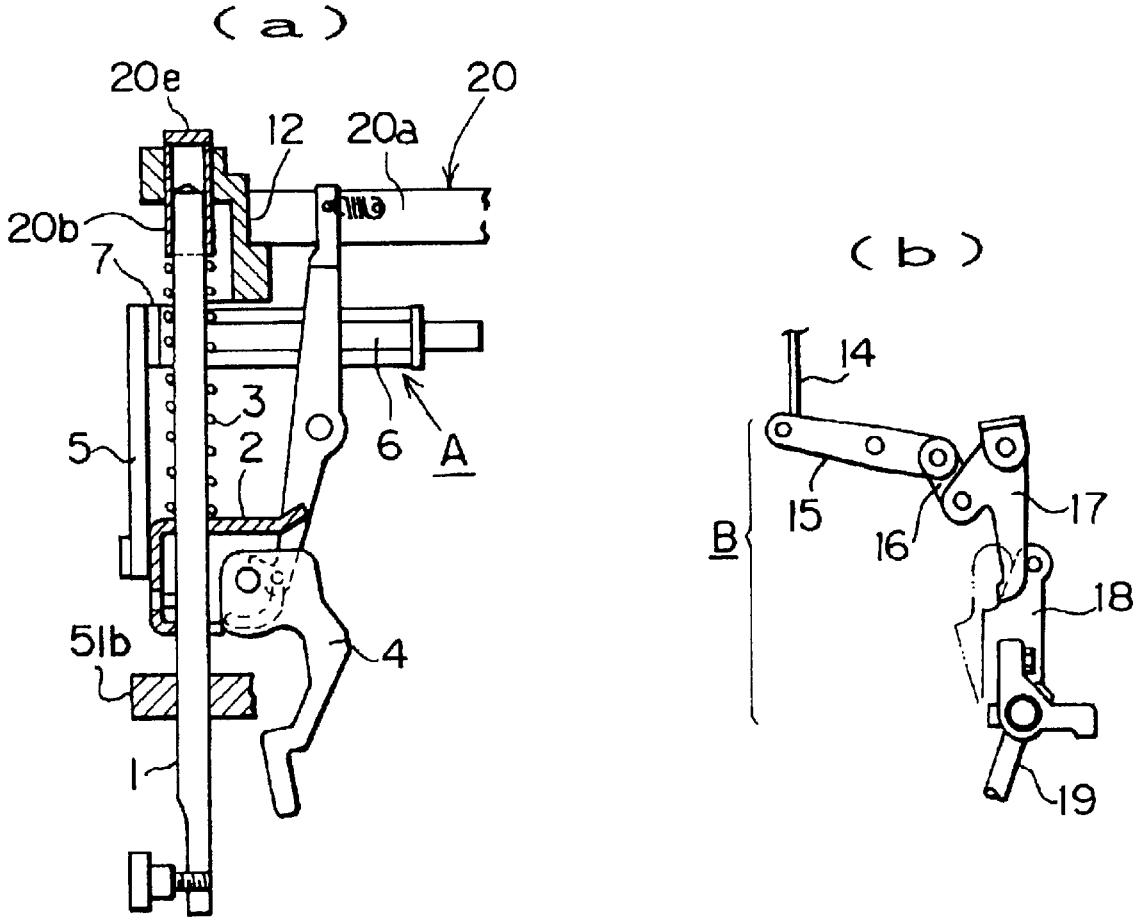
Figure 4:
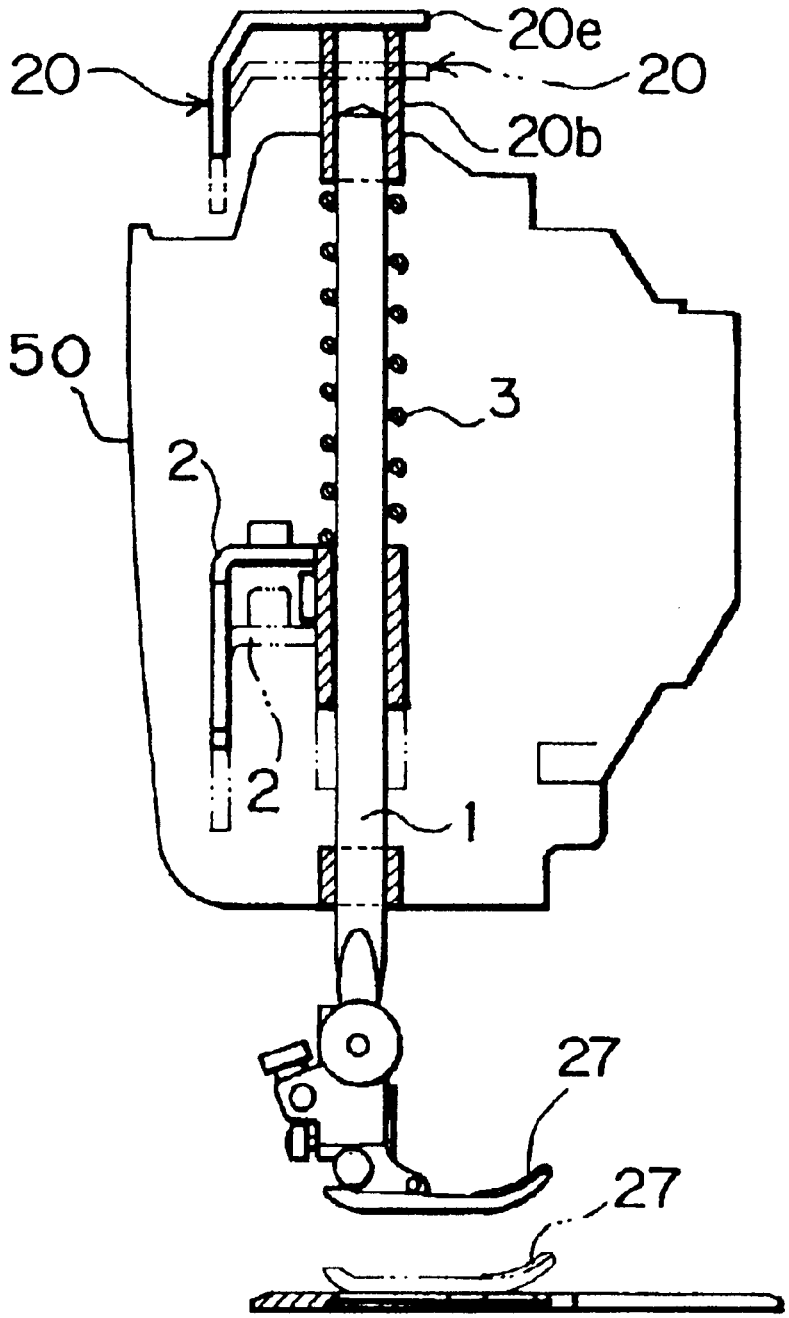

FIG. 4:

A side elevational view of FIG. 3(*a*) partly abbreviated and showing a condition in which a pressure applied to the presser bar is reduced.

FIG. 5:

(a) is a plan elevational view of a pressure adjusting mechanism including a pulse motor partly shown in horizontal section.

(b) is a side elevational view of (a) partly shown with imaginary line.

(c) is a plan elevational view of a mechanism for adjusting a pressure applied to the presser bar and for lifting the presser bar.

FIG. 6:

(a) is a front elevational view of a part of FIG. 2(*a*) showing a mechanism operated to adjust a pressure applied to the presser bar into one pressure condition.

(b) is a front elevational view of a mechanism for operating the mechanism of (a).

Figure 6:
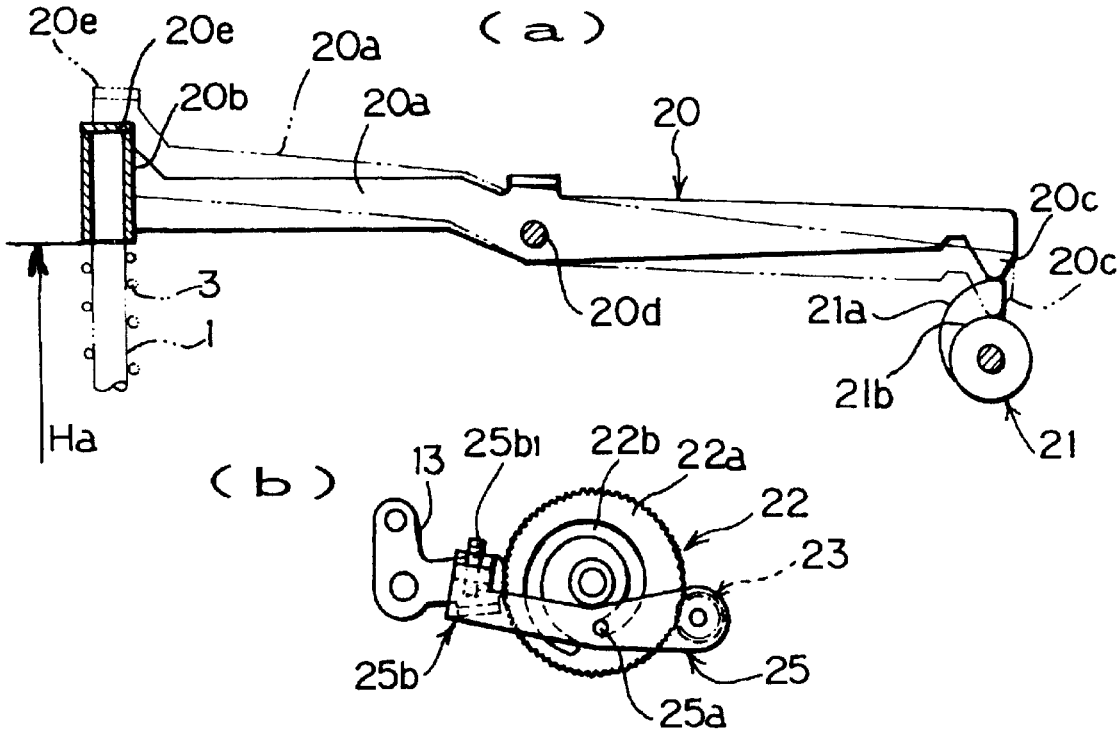

FIG. 7:

(a) is the same view with FIG. 6(*a*), but showing the mechanism operated to adjust a pressure applied to the presser bar into another pressure condition.

(b) is the same view with FIG. 6(*b*) showing the mechanism operating the mechanism of (a).

FIG. 8:

(a) is a front elevational view of another embodiment of the invention, wherein the presser bar is moved down.

(b) is the same view with (a), but wherein the presser bar is moved up.

(c) is a perspective view of an essential part of the invention including an intermediate member of a second type.

(d) is a perspective view of an essential part of the invention including an intermediate member of a third type (e) is a perspective view of an essential part of the invention including no intermediate member.

Figure 9:
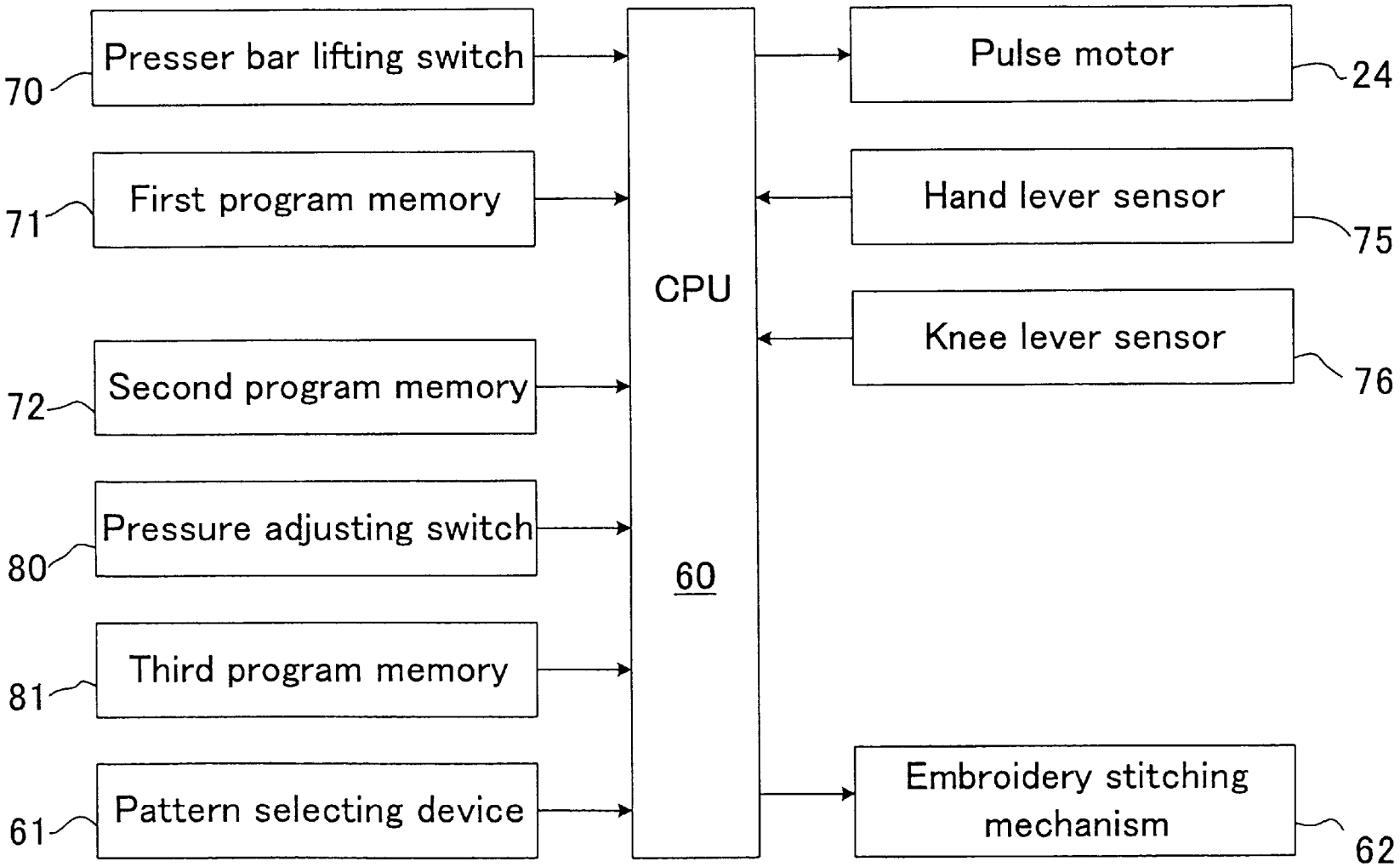

FIG. 9 is a block diagram showing the functions of the sewing machine of the invention.

DETAILED DESCRIPTION OF PREFERRED EMBODIMENTS

At first, the preferred embodiments of the invention will be generally summarized. The characteristic points of the embodiments are as follows:

The presser foot 27 may be lifted by operation of hand lever 4 or knee lever 19. When the presser foot lifting operation is performed, the pressure normally applied to the presser foot by spring 3 is nullified and the presser foot lifting operation may be performed very easily. The nullification of pressure is one of the operations made by pressure adjusting mechanism C. The presser foot lifting operation may also be made by use of drive device.

Further, the pressure of the spring 3 may be easily adjusted by the pressure adjusting mechanism C. The pressure adjusting mechanism C includes pulse motor 24 which may be driven under control from pressure adjusting dial 80 or pattern selecting device 61.

The invention will be further described in reference to the embodiment as shown in FIG. 9.

The sewing machine according to the embodiment is provided with embroidery stitching mechanism 62 which is operated under control of CPU 60 to form the stitches of an embroidery pattern selected by operation of the pattern selecting device 61.

The sewing machine is provided with presser bar lifting switch 70 which is operated to control the operation of the pulse motor 24 in accordance with a pressure nullifying program stored in a first program memory 71, thereby to nullify the pressure of the spring 3 and to lift the presser foot 27 as will be described in detail hereinlater.

Further, the sewing machine is provided with hand lever sensor 75 and knee lever sensor 76 which are operative to give a signal respectively in response to operation of the hand lever 4 and the knee lever 19, thereby to firstly control the operation of the pulse motor 24 in accordance with a pressure nullifying program stored in a second program memory 72 to nullify the pressure of the spring 3 so that the presser foot 27 may be lifted with a reduced force by manual operation of the hand lever 4 or the knee lever 19.

The pressure of the spring 3 may be adjusted by operation of the pressure adjusting dial 80. With operation of the dial 80, the pulse motor 24 is driven in accordance with a pressure adjusting program stored in a third memory 81, thereby to enable the pressure adjusting mechanism C to adjust the pressure of the spring 3. Further, the pattern selecting device 61 may be operated to select an optional pattern and simultaneously operate the pressure adjusting mechanism C to adjust the pressure of the spring 3.

The invention will be described in detail in reference to the preferred embodiments as shown in the attached drawings. A presser bar 1 is fixedly connected to a presser bar holder 2. The presser bar 1 has a presser foot 27 removably mounted to the lower end thereof The presser bar holder 2 is normally pressed down by a compression spring 3. The presser bar holder 2 supports the presser bar 1 and transmits to the latter a movement moving up and down, thereby to move the presser foot 27 between a lower operative position where the presser foot 27 is pressed against a needle plate and an upper inoperative position where the presser foot is spaced from the needle plate in vertical direction.

A presser bar lifting lever portion 4 is mounted to a position where the presser bar holder 2 is provided [FIG. 1(*a*)]. With rotating operation of the presser bar lifting lever portion 4 ,the presser bar holder 2 is move up and down. The presser bar lifting lever portion 4 is operatively connected to a circuit for operating a swingable member 20 and a pulse motor 24 so that the presser bar lifting lever portion 4 may be easily operated as will be described in detail hereinlater.

The presser bar holder 2 is connected to an elevator mechanism A through an elevator link 5 [FIG. 1(*b*)]. The elevator mechanism A may be operated by an operating means which is other than the presser bar lifting lever portion 4 so as to move up and down the presser bar holder 2. The operating means which is other than the presser bar lifting lever portion 4 includes a knee operated mechanism B or an electrically operated mechanism as will be described in detail hereinlater.

The elevator link 5 has an elongated opening 5a formed therein as extended therealong. An elevator shaft 6 is connected to an elevator arm 7. The elevator shaft 6 is operated in association with vertical swinging movement of the elevator arm 7 to vertically move the elevator link 5, thereby to vertically move the presser bar holder 2. A link mechanism 8 is provide to change the vertical swinging movement of the elevator arm 7 to horizontal movement of the elevator arm 7. A transmission rod 9 has one end connected to the link mechanism 8 and has the opposite end connected to the knee operated mechanism B [FIG. 1(*a*)] which will be described in detail hereinlater.

The elevator mechanism A is provided with a cam 10 and a follower arm 11 for making vertical reciprocating movement in case of embroidery stitching operation. The follower arm His connected to the elevator shaft 6 and is swingingly moved in association with rotation of the cam 10, thereby to vertically move the presser bar holder 2 [FIG. 1(*b*)], such that the presser foot 27 may be moved in time with movement of an embroidering frame and formation of stitches in case of embroidery stitching operation.

Subsequently, the knee operated mechanism B will be described in reference to FIG. 1(*a*) and FIG. 3(*a*). The knee operated mechanism B is operatively connected to the elevator mechanism A through the link mechanism 8, the transmission rod 9, an intermediate link 13 and a transmission rod 14 and is operated with the user's knee to operate the elevator mechanism A, thereby to vertically move the presser foot 27 between the lower operative position and the upper inoperative position. The intermediate link 13 is generally L-shaped and has one end connected to the transmission rod 9 and the opposite end connected to the transmission rod 14 to effectively transmit the movement of the knee operated mechanism B to the elevator mechanism A.

The knee operated mechanism B includes a link structure comprising a first transmission link 15 having one end connected to the lower end of the transmission rod 14, a second intermediate link 16 having one end connected to the opposite end of the first link 15 and a third link 17 having one end connected to the opposite end of the second intermediate link 16 which has the opposite end connected to a lever holder 18. A knee lever 19 is removably connected to the lever holder 18. The knee lever 19 is operated by the knee of the machine user to vertically move the presser bar 1 between the upper inoperative position and the lower operative position through the knee operated mechanism B and transmission rods 14 and 9.

Subsequently, a pressure adjusting mechanism C will be described. The pressure adjusting mechanism includes mainly a swingable member 20, a cam 21, a gear 22, an intermediate gear 23 and a pulse motor 24 having a pinion 24*a* which is in mesh with the intermediate gear 23. The swingable member 20 includes a follower lever 20*a* which has an intermediate portion swingably supported on a machine frame by a support pin 20*d* [FIG. 1(*a*), FIGS. 2(*a*) and (*b*)]. The swingable member 20 has one end being directly or indirectly in contact with the top of the compression spring 3 with an interposed member provided therebetween. The swingable member 20 has the opposite end 20*c* being held in contact with the periphery of the cam 21 so as to move the interposed member up and down, thereby to adjust the position of the top of the compression spring 3.

The interposed member includes a cylindrical bushing 20*b* which is vertically movable as is guided by a guide 12 formed at the machine frame. The bushing 20*b* loosely receives the upper part of the presser bar 1 and has the lower end being in contact with the top of the compression spring 3 [FIGS. 2(*a*) and (*b*)]. More precisely, the presser bar 1 is vertically moved as is guided by the bushing 20*b* at the upper portion thereof and by a lower guide 51*b* which is a part of the machine frame. The end 20*e* of the swingable member 20 is pressed against the top of the bushing 20*b* and is indirectly pressed against the top of the compression spring 3. The bushing 20*b* may be pivotally connected to the follower lever 20*a* to obtain the same effect.

Figure 5:
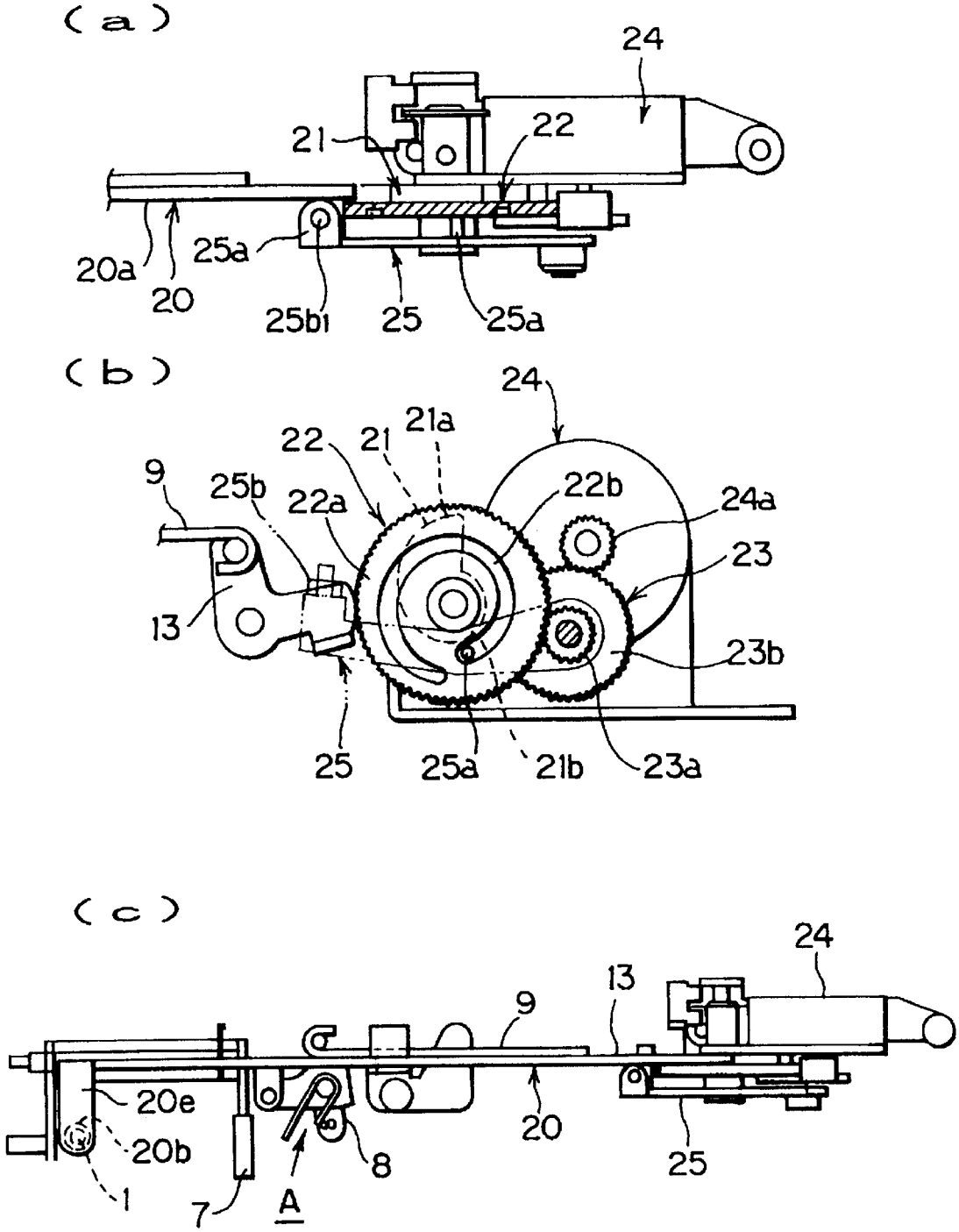

The pressure adjusting mechanism C is operated by the pulse motor 24 as shown in FIGS. 5(*a*) and (*b*). The cam 21 has a projected periphery 21*a* and a circular periphery 21*b* which may be selectively engage the end 20*c* of the swingable member 20 as the cam 21 is rotated, thereby to swing the swingable member 20. With the swinging movement of the swingable member 20, the bushing 20*b* is vertically moved and therefore, the compression spring 3 is compressed and expanded. Thus the elastic force of the compression spring 3 is adjusted.

Figure 8:
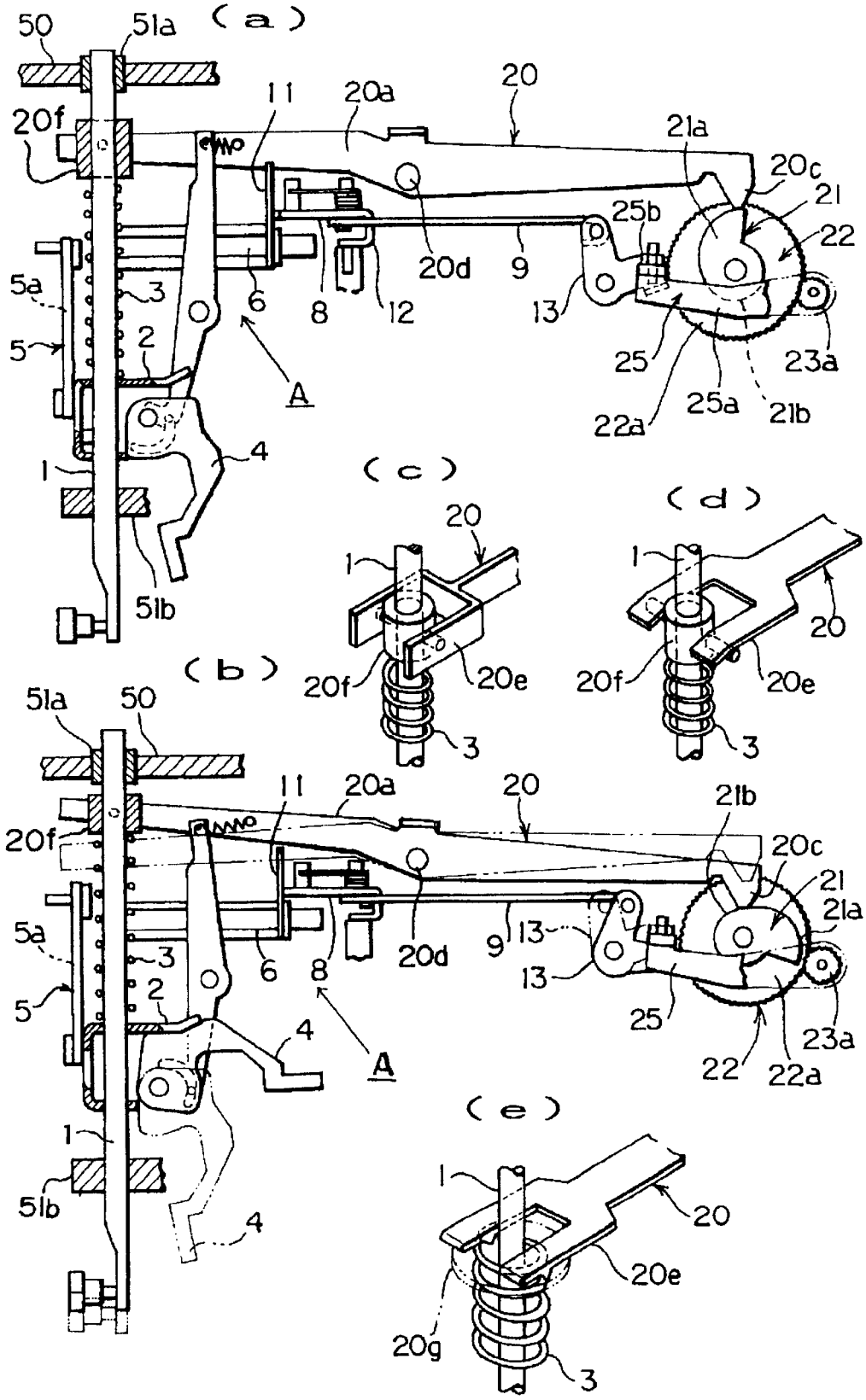

As a second type of the interposed member, the bushing 20 may be replaced by a cylindrical slide member 20*f* slidably mounted on the presser bar 1 [FIGS. 8(*a*) and (*b*)]. The slide member 20*f* is pivotally connected by a pin to a forked end 20*e* of the swingable member 20 to act on the top of the compression spring 3. In this case, the upper part of the presser bar 1 is inserted into a cylindrical guide 51*a* which is fixedly mounted to the machine frame 50 [FIG. 8(*c*) ].

As a third type of the interposed member, instead of pivotally connecting the slide member 20*f* to the forked end 20*e* of the swingable member 20 by the pin, the forked end 20*e* may be pressed against the pin laterally extended from the slide member 20*f* to obtain the same effect [FIG. 8(*d*)]. According to the second and third types, the interposed member is simply pressed against the top of the compression spring 3 while the presser bar 1 is vertically movable as is guided by the upper guide 51*a* and the lower guide 51*b*. The presser bar 1 may, therefore, be vertically moved in precise and stabilized condition.

Further, instead of providing the interposed member between the swingable member 20 and the compression spring 3, the end 20*e* of the swingable member 20 may be directly pressed against the top of the compression spring 3, so that the swinging movement of the swingable member 20 may directly act on the compression spring 3 [FIG. 8(*e*)]. In this connection, a washer 20*g* may be placed between the end 20*e* of the swingable member 20 and the compression spring 3.

The pressure adjusting mechanism C may be operated to lift the presser bar 1 by means of a switch 70. The mechanism will be described.

The cam 21 and the gear 22 are coaxial and formed in one body so that the two members may be rotated together. The gear 22 has a cam groove 22*b* formed on one side thereof. The cam groove 22*b* is spirally formed around the center axis of the gear body 22*a*. One end of the cam groove 22*b* is located near the center axis of the gear body 22*a* and is extended progressively far from the center axis to a furthest opposite end.

The gear 22 is in mesh with the intermediate gear 23. Precisely the intermediate gear 23 is composed of a pinion 23*a* and a gear body 23*b* which are coaxial and formed in one body. The gear 22 is in mesh with the pinion 23*a*. The cm body 23*b* of the intermediate gear 23 is in mesh with the pinion 24*a* which is secured to the drive shaft of the pulse motor 24 which is driven under control of CPU. Further, LCD and TTP may be used in combination to set an optional pressure applied to the presser bar 1.

A link 25 is provided to be swingingly moved around an axis of one end thereof which is arranged in coaxial with the intermediate gear 23. The link 25 has the opposite end operatively connected to the link 13. The link 25 is operated in association with drive of the pulse motor 24 to lift the presser bar 1.

The link 25 has a guide pin 25*a* fixed to the intermediate thereof and engaging the cam groove 22*b* of the gear 22, so that the link 25 may be swingingly moved around the center axis of the intermediate gear 23 as is guided by the cam groove 22*b* as the gear 22 is rotated by the pulse motor 24 through the intermediate gear 23.

The link 25 has the opposite end 25*b* having a screw $\mathbf{25}b_1$ securer thereto and engaging the end of the link 13. Precisely the link 25 may be swingingly moved to rotate the link 13 in the clockwise direction, thereby to move up the presser bar holder 2 [FIG. 8(*a*)].

The link 25 is swingingly moved by the pulse motor 24 through the intermediate gear 23, gear 22 and the cam groove 22*b*. The pulse motor 24 is driven by operation of the switch 70 under control of the CPU 60.

As is apparent from the foregoing description, the pulse motor 24 may be driven to have an optional rotation angle, thereby to optionally set the rotation angle of the cam 21 through the intermediate gear 23, and the gear 22. As the result, the swing angle of the swingable member 20 may be varied. With variation of the swing angle of the swingable member 20, the spring force of the compression spring 3 will be varied accordingly through the bushing 20*b*. Therefore, the spring force to the presser bar 1 may be optionally adjusted or may be nullified. Thus the operation for lifting the presser bar will become so easy. Further with rotation of the gear 22, the cam groove 22*b* will swing the link 25 to rotate the link 13 through the screw 25$b_1$, hereby to move up and down the needle bar holder 2 instead of manually moving up and down the needle bar holder 2.

A dial 80 is provided on the sewing machine for setting the rotation angle of the pulse motor 24 to optionally select a pressure force of the presser bar 1, thereby to adjust the pressure force of the presser foot 27 step by step.

The dial 80 may be replaced by a touch panel structure which may be operated at the touch panel to set the pressure applied to the presser bar 1 step by step or successively. By use of the pressure adjusting dial 80 to set the rotation angle of the pulse motor 24, an extremely high precision of pressure adjustment may be attained. Further, the pattern selecting device 61 may be utilized to produce a signal for setting the rotation angle of the pulse motor 24 to select a pressure for a selected pattern to be stitched, a selected mode of stitching, a selected mode of stitches to be formed, and for the normal stitching mode and the embroidery stitching mode, and further for a moving distance an embroidering frame in case of the embroidery stitching operation. For example, in case a pattern of zigzag stitches is to be formed, the pressure may be set lower than in case of straight stitching. Thus the pressure may be optionally varied in accordance with designation of various patterns to be formed and various types of cloth to be stitched.

According to the embodiments as mentioned above, the pressure applied to the presser bar 1 may be adjusted by driving the pulse motor 24 which operates the gear mechanism and the link mechanism which are operatively connected to the compression spring 3. Further, the pressure may be reduced by manual operation of the presser bar lifting lever 4 or the knee lever 19 which will operate the swingable member 20 to move up the end 20*e* thereof instead of using the pulse motor 24 and the gear mechanism. In this case, the swingable member 20 may be substantially disconnected from the gear mechanism, the upper portion of the presser bar 1 is inserted into the bushing 20*b* which may be vertically moved by a guide 12.

The presser foot 27 is lifted by manual operation of the lever 4 and the knee lever 19. With manual operation of the lever 4 and the knee lever 19, the pulse motor 24 is driven to rotate the intermediate gear 23 and the follower gear 22. The cam 21 is, therefore, rotated together to an angularly initial position where the circular periphery 21*b* of smaller radius of the cam 21 comes to engage the end 20*c* of swingable member 20 from the angular position where the projected portion 21*a* of the cam 21 engages the end 20*c* of swingable member 20 and the vertical position of the bushing 20*b* is Ha [FIG. 6(*a*)].

Figure 7:
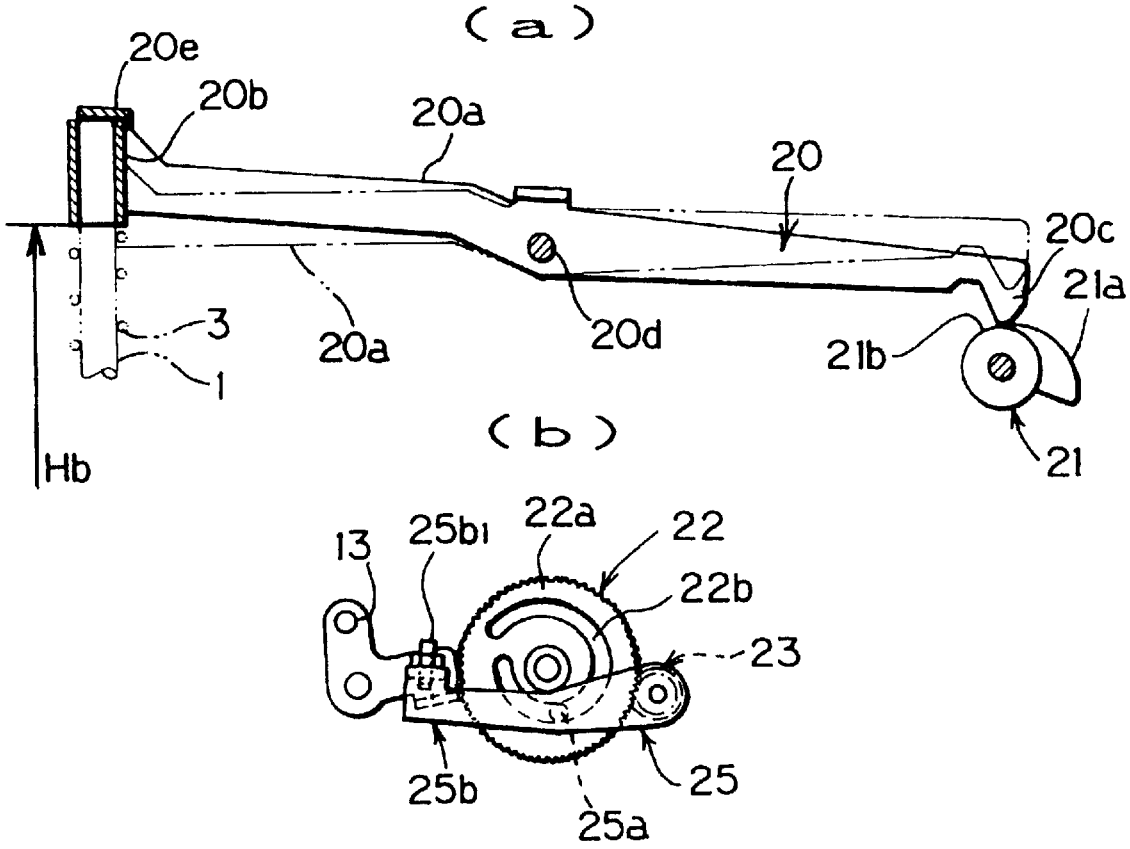

When the end 20*c* of the swingable member 20 comes to engage the cam portion 21*b* of the cam 21, the swingable member 20 is swingingly moved so that the opposite end 20*e* thereof may be moved up to allow the the bushing 20*b* to move up due to the pressure of the compression spring 3 from the vertical position Ha to Hb [FIG. 7(*a*)]. Therefore, the downward pressure of the compression spring 3 applied to the presser bar 1 is reduced because the compression spring 3 is provided between the bushing 20*b* and the presser bar holder 2 which is fixedly connected to the presser bar 1. Thus the presser bar lifting operation may become extremely easy.

In case the presser bar 1 is automatically lifted up, the switch 70 is turned on to drive the drive motor 24 to rotate the cam 21 as mentioned above to siwingingly move up the end 20*e* of the swingable member 20, thereby to allow the bushing 20*b* to move up due to the upward pressure of the compression spring 3 as shown in FIG. 7(*a*). Simultaneously the link 25 is turned down in association with rotation of the cam groove 22*b* which is in engagement with the guide pin 25*a* of the link 25 as shown in FIG. 7(*b*). As the result, the screw 25$b_1$ of the free end 25*b* of the link 25 will rotate the link 13 in the clockwise direction, thereby to move up the presser bar holder 2 through the elevator mechanism A.

Thus according to the invention, the elongated swingable member 20 is swigingly moved around the center support pin 20*d* to adjustably vary the downward pressure of the compression spring 3 normally applied to the presser bar 1. Therefore, the downward pressure applied to the presser bar 1 may be adjusted so easily and rapidly. Further, the swingable member 20 is swingingly moved in association with operation of the presser bar lifting member to reduce the downward pressure of the compression spring 3 applied to the presser bar 1. Therefore, the presser bar lifting operation may be performed so easily with absence of a strong resistance of pressure. As is apparent from the foregoing description, the invention may reduce a mechanical pressure which will otherwise be applied to the related members in the presser bar lifting operation, and the working life of the sewing machine may be elongated while the sewing machine is operated so well.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A sewing machine with a device for adjusting a downward pressing force applied to a presser bar having a presser foot removably mounted to the lower end thereof and being vertically movable by means of a presser bar holder between an upper inoperative position where the presser foot is vertically spaced from a needle plate and a lower operative position where the presser foot is pressed against the needle plate, said sewing machine comprising:

spring means for normally acting on said presser bar to give the same a downward pressing force;

swingable means having one end normally engaging said spring means and having the opposite end for giving swinging movement to said swingable means to displace said one end, thereby to adjust the pressing force of said spring means.

2. The sewing machine as defined in claim 1, further comprising a bushing mounted to said presser bar and being movable therealong, wherein said spring means is provided between said bushing and said presser bar holder, and said one end of said swingable means engages said spring means through said bushing.

3. The sewing machine as defined in claim 1, further comprising drive means for giving swinging movement to said swingable means.

4. The sewing machine as defined in claim 3, further comprising pressure selecting means for selecting a pressing force applied to said presser bar, said pressure selecting means being selectively operated to drive said drive means to swing said swingable means, thereby to displace the said one end of said swingable mans in accordance with a selected pressing force.

5. The sewing machine as defined in claim 3, further comprising embroidery stitching means; pattern selecting means for selecting a pattern to be embroidered, said pattern selecting means being operated to drive said drive means to swingingly move said swingable means to a position where the pressing force of said spring means is adjusted to give a predetermined pressing force for a selected pattern.

6. The sewing machine as defined in claim 3, wherein said drive means includes a pulse motor.

7. A sewing machine with a device for lifting a presser bar from a lower operative position to an upper inoperative position, said sewing machine comprising:

spring means for normally acting on said presser bar to give the same a downward pressing force;

swingable means having one end normally engaging said spring means and having the opposite end for giving swinging movement to said swingable means to displace said one end, thereby to adjust the pressing force of said spring means;

presser bar lifting means for lifting said presser bar from said lower operative position to said upper inoperative position;

means operated in association with operation of said presser bar lifting means to swingingly operate said swingable means to cause said one end thereof to nullify the pressing force of said spring means.

8. The sewing machine as defined in claim 7, further comprising drive means for operating said presser bar lifting means and said swingable means, said drive means being driven to firstly operate said swingable means to nullify the pressing force of said spring means and subsequently operate said presser bar lifting means to lift said presser bar from said lower operative position to said upper inoperative position.

9. The sewing machine as defined in claim 7, wherein said presser lifting means includes a device which is manually operated to lift said presser bar from said lower operative position to said upper inoperative position, the operation of said manually operated device including an initial operation to operate said swingable means to displace said one end thereof to decrease the pressing force of said spring means and a subsequent successive operation to lift said presser bar from said lower operative position to said upper inoperative position.

10. The sewing machine as defined in claim 9, further comprising drive means for operating said swingable means.

11. The sewing machine as defined in claim 9, wherein said manually operated means may beoperated by hand.

12. The sewing machine as defined in claim 9, wherein said manually operated means may be operated by knee.

13. A sewing machine with a device for lifting a presser bar from a lower operative position to an upper inoperative position, said sewing machine comprising:

a holder for fixedly holding said presser bar;

a bushing mounted to said presser bar and being vertically movable therealong;

a swingable member having one end operatively connected to said bushing and having the opposite end pressed against a positioning member for positioning said one end of said swingable member;

a spring arranged between said bushing and said presser bar holder and normally giving an upward pressing force to said bushing and a downward pressing force to said presser bar holder;

means for moving up said presser bar holder to lift said presser bar from said lower operative position to said upper inoperative position;

drive means for operating said presser bar holder moving up means and said positioning member, said drive means initially operating said positioning member to displace said one end of said swingable member to allow said bushing to move up, thereby to reduce the pressing force of said spring and subsequently operating said presser bar holder to move up, thereby to lift said presser bar from said lower operative position to said upper inoperative position.

* * * * *